US006362431B1

(12) United States Patent
Gutierrez et al.

(10) Patent No.: US 6,362,431 B1
(45) **Date of Patent: *Mar. 26, 2002**

(54) ULTRA THIN WALL PRIMARY CABLE FOR AUTOMOTIVE SERVICE

(75) Inventors: Carlos Tenorio Gutierrez; Artemio Martinez Corona, both of Querétaro (MX)

(73) Assignee: Servicios Condumex S.A. de C.V., Queretaro Qro (MX)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/044,840

(22) Filed: Mar. 20, 1998

(30) Foreign Application Priority Data

Mar. 20, 1997 (MX) ..... 972115

(51) Int. Cl.[7] ..... H01B 7/02
(52) U.S. Cl. ..... 174/110; 174/128.1
(58) Field of Search ..... 174/110 SR, 110 V, 174/128.1, 126.1, 128.2, 129 R, 133 R

(56) References Cited

U.S. PATENT DOCUMENTS 3,131,469 A * 5/1964 Glaze ..... 174/128.1 X
3,234,722 A * 2/1966 Gilmore ..... 174/128.1 X
3,760,093 A * 9/1973 Pemberton ..... 174/128.1
4,039,743 A * 8/1977 Gommans ..... 174/128.1 X
4,734,545 A * 3/1988 Susuki et al. ..... 174/110 SR X
5,149,917 A * 9/1992 Sawada et al. ..... 174/129 R
5,216,205 A * 6/1993 Fujii et al. ..... 174/128.1
5,260,516 A * 11/1993 Blackmore ..... 174/128.1 X
5,449,861 A * 9/1995 Fujino et al. ..... 174/128.1 X
5,514,837 A * 5/1996 Kenny et al. ..... 174/113 R
5,795,652 A * 8/1998 Bell et al. ..... 428/383

* cited by examiner

*Primary Examiner*—Chau N. Nguyen
(74) *Attorney, Agent, or Firm*—Carmen Pili Curtis

(57) ABSTRACT

An ultra thin wall primary cable for automotive service including a conductor nucleus including a smooth, annealed, geometrically formed joint of copper wires, and an insulating thermoplastic cover including polyvinyl chloride which is lead free, flame retardant, and resistant to abrasion, gasoline and pinch test. The cable is fabricated in three stages including: i) stretching copper wires by a one-row or multi-row drawing machine; ii) passing the copper wires through a single or double torsion joining machine; wherein steps (i) and (ii) are performed in such manner as to result in a geometrically constructed joint which is sufficiently smooth and having slight undulations; iii) positioning the insulating thermoplastic cover concentrically around the conductor nucleus; and iv) extruding the thermoplastic cover around the conductor nucleus.

18 Claims, 1 Drawing Sheet

ULTRA THIN WALL PRIMARY CABLE FOR AUTOMOTIVE SERVICE

BACKGROUND OF THE INVENTION

The automotive industry often requires the usage of new technologies that allow the constant innovation of its new aerodynamic models. Among this kind of necessary technological developments there are the processes focused on the manufacturing of the automotive primary cable of low tension.

The quality, service, and prices must be competitive in world markets, this will only be achieved by continuing to make technological changes as the automotive industry does.

The ultra-thin wall cable is an example of these technological changes. Since they have competitive advantages in their manufacturing, with an adequate equipment, they offer a quality product with competitive prices.

The cable has some advantages over a conventional cable, its objective is to lighten the vehicle weight. It increases the fuel efficiency and the production, it standardizes the numbers in the chemical-physical and mechanical tests, it reduces the wall thickness, it allows a bigger circuit integration in the harness offering more options of commodity and comfort, among others.

Nowadays, most of the conductors used for a gauges smaller than 22 are made from a very refined electrolytic copper or alloys, which has a typical characteristic of elongation and switch intensity of 30+% and 135,000 $lb/in^2$. An inadequate intensity or rigidity conductor can produce stretching of the wire during the cut of circuits in the manufacturing of automotive harnesses. An inadequate rigidity conductor can provoke a loss of orientation of the wire during the last application.

The intensity of the conductor is important in the extrusion operation and principally in the continuous crosslinking of the curing and insulation operations. The conventional thermoplastic PVC insulation materials that are now used, have a wire wall of 16 thousandth thick, to reduce these numbers, other PVC material or special mixtures are required. The reduced size wire needs improvements in the conductor manufacturing, more precision during the stage of extrusion of the insulation and improvements in the insulating material.

The applicant has developed, for these new necessities, a primary cable of low tension, It is characterized by an ultra-thin insulation thickness. It is an automotive cable with a red copper conductor, smooth and annealed according to the ASTM B-3 norm, that permits to conduct electric current (ohmica) to any part of an automotive vehicle.

DESCRIPTION OF THE INVENTION

Figure 1:
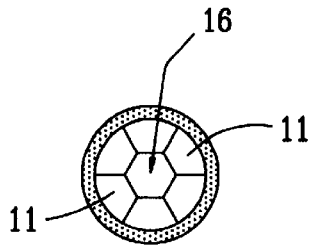
Figure 2:
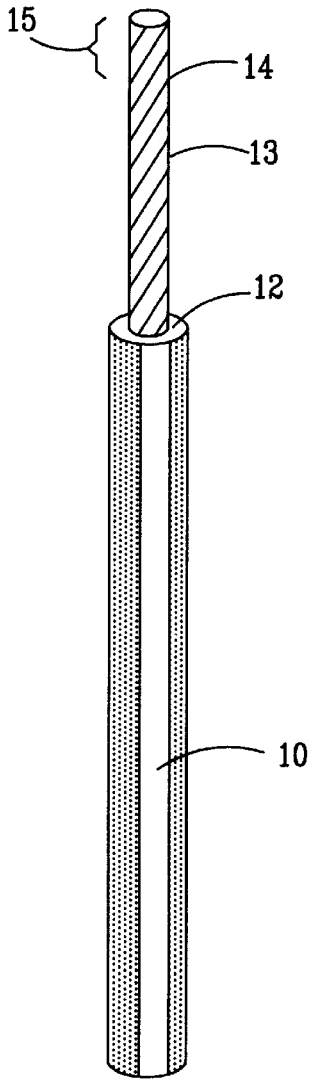

The invention is described above in a more detailed way according to the drawing of the FIG. 1, making it more clear without restraining its reach, where the FIG. 2, is a sectional cut of cable in a transversal form.

The principal characteristic of the ultra-thin wall cable is the usage of geometrically shaped wire constructions 11 so as to achieve a symmetrical arrangement of six wires 11 about the central core wire 16 so as to obtain the cable conductor nucleus, (preferably of 18 to 22 or 29 AWG) and wherein said cable conductor nucleus has a smooth finish characterized by hollows 14 which are of reduced size as compared to the hollows of conventionally constructed cables. It is the smooth finish of the conductor nucleus which permits extrusion of the insulating cover with a uniformity of concentricity which permits a large reduction in thickness, i.e., an ultra-thin wall. It also uses a PVC ecological component (free of lead) PVL 185 LP and resistant to the abrasion and pinch tests.

It considerably reduces the indexes of leftovers for the usage of construction 11, symmetrical of 7 wires, it permits more productivity because of the easy and quickly material handling, the wiring of the machine with just 7 wires, and the usage of ceramic.

The innovative characteristic of the primary cable of ultra-thin wall 10 for automotive usage is that a geometrically formed conductor of copper wires 13, is used. They are joined in a bundle form that allows an excellent finish in the exterior diameter of the cord. As a result the cover 12 of an ecological insulation can be set in a concentric way, obtaining a standardization in the results of the chemical-physical test allowed by the insulating design.

The process of the cable (cord) joining can be done in a joining machine of simple and double torsion, only if the cord to be joined is of uniform quality.

The cable is fabricated in 2 or more steps 15, (the step is the length of the straight line running from a starting point to the point at which a given wire of the cable appears at the analogous point after having gone one rotation around the helicoidal structure of the cable). The area of the cord is equal to $\pi/4 \times d^2$ per number of wires. (Note ASTM B 263).

Manufacturing

The manufacture of the primary cable is made according to the following stages

Stretching—A 26 gauge wire is stretched sufficiently that a joint of seven of said wires forming an 18 gauge cable can be fabricated. A 28 gauge wire is stretched sufficiently that a joint of seven of said wires forming a 29 gauge cable can be manufactured. A 30 gauge wire is stretched sufficiently to manufacture a 22 gauge cable.

All gauges are according to American wire gauge norm AWG. They are obtained by stretching in one-row or multi-row machines.

These are the three wires required for this family of cables and the usage of individual wires is necessary for a better tension control in each of the wires.

Joint—In this second stage a joining machine of simple or double torsion is used (that permits the same quantity of joint cord) without a pre-twister and using geometrical constructions.

Extrusion—Finally, as the third stage a cover or insulator of thermoplastic component of PVC (polyvinyl chloride) will be set in a concentric form so a thickness of standardized insulation can be achieved, and with this, results in the constant mechanical tests, resistant to the abrasion and pinched and ecological test, can be extruded in any extrusion machine for thermoplastics, achieving bigger indexes of production comparing them to a primary cable of asymmetrical construction.

The ultra-thin wall cover on the 18 gauge AWG cable is produced by extrusion at an average lineal speed of 1000 MPM in an extrusion machine of 10 mm capacity.

Among the advantages offered by ultra-thin wall on many cable: The usage of geometrical constructions allow an excellent superficial finish.

The usage of geometrical constructions allows an excellent superficial finish, a bigger production in extrusion areas, more linear speeds and a reduction of leftovers for centering problems. As a result the harness weight is reduced in the assembling within other circuits to transmit the current to any part of the vehicle, the reason for what they have been made.

This cable should be carefully fabricated so as to provide control of equal tension when joining all wires and each wire has to have the maximum electric resistance (ohmica) allowed, since it is the characteristic that rules the design of the cable.

The ultra-thin wall (reduced thickness) cable has some advantages over the other primary cables designed with asymmetrical constructions. Since a bigger standardization on the insulation thickness is achieved when the hollows 14 are reduced between every step of twisting of the filaments and with this, a standardization on the results of the chemical-physical and mechanical test is accomplished. These tests are obligatory because of its design, and the production indexes are bigger and the leftover indexes are smaller.

This cable is used in the fabrication of an automotive harness where it will be exposed to work temperatures of −40° C. to 105° C. range of temperatures specified by the design of the electric automotive systems.

What is claimed is:

1. An ultra-thin wall cable for automotive service comprising:

a) a conductor nucleus consisting essentially of a smooth, annealed, geometrically formed joint of copper wires; and b) an insulating thermoplastic cover which is being formed of polyvinyl chloride (PVC) composition which is lead free, flame retardant, resistant to abrasion and gasoline and pinch test, said cable fabricated in three stages:

i) stretching said copper wires by a one-row or multi-row drawing machine;

ii) passing said wires through a single or double torsion joining machine; wherein steps (i) and (ii) are performed in such manner as to result in a geometrically constructed joint which is sufficiently smooth and having slight undulations without using an adhesive;

iii) positioning the insulating thermoplastic cover concentrically around said conductor nucleus; and iv) extruding said cover around the conductor nucleus.

2. The ultra-thin wall cable of claim 1, wherein the cover is less than 0.016 inch thick.

3. The ultra-thin wall cable of claim 2, wherein said geometrically formed joint has hollows between the wires and wherein said hollows are of reduced size as compared to conventionally constructed cables.

4. The ultra-thin wall cable of claim 3, wherein said conductor nucleus comprises a double twisted bundle wherein the surface of the exterior circumference of said nucleus is substantially in the form of a plain tubular wall.

5. The ultra-thin wall cable of claim 4, wherein said conductor nucleus is formed by a symmetric construction of seven of said wires each wire having a size of 18 to 22 AWG.

6. The ultra thin wall cable of claim 3 capable of being used at to a temperature of −40° C. to 105° C.

7. The ultra thin wall cable of claim 1 wherein step (ii) is conducted in the absence of a pretwister.

8. The ultra thin wall cable of claim 1 wherein step (iv) is conducted at a lineal speed of 1000 MPM in an 18 gauge AWG.

9. The ultra thin wall cable of claim 1 wherein the cable is capable of being used at a temperature of −40° C. to 105° C.

10. The ultra thin wall cable of claim 1 further comprising forming a symmetric construction of seven of said wires, wherein each wire has a size of 18 to 22 AWG.

11. The ultra thin wall cable of claim 1 wherein said geometrically formed joint has hollows between the wires and wherein said hollows are of reduced size as compared to conventionally constructed cables.

12. The ultra-thin cable of claim 1 wherein in step (i), with 26 gauges in a joint of seven copper wires, the cable of gauges 18 is fabricated.

13. The ultra-thin cable of claim 1 wherein in step (i), with 28 gauges in a joint of seven copper wires, the cable of 29 gauges is manufactured.

14. The ultra-thin cable of claim 1 wherein in step (i), with 30 gauges in a joint of seven copper wires, the cable of 22 gauges is manufactured.

15. A non-adhesive ultra thin wall cable for automotive service comprising:

a) a central wire and a plurality of wires of helically applied wires surrounding said central wire to form a conductor nucleus comprising a smooth, annealed, geometrically formed joint of copper wires; the layer of joint wires of the conductor nucleus being stretched to form a lesser gage after stretching;

b) an insulating thermoplastic cover concentrically around and directly adjacent to said conductor nucleus; said thermoplastic cover consisting essentially of polyvinyl chloride; and said insulating thermoplastic cover extruded over the conductor nucleus.

16. The non-adhesive ultra thin wall cable of claim 15 wherein the layers of joint wires are the same size as the central wire.

17. The non-adhesive ultra thin wall cable of claim 15 wherein said conductor nucleus obtains the smooth finish by annealing at 400° C. in one or more steps.

18. The non-adhesive ultra thin wall cable of claim 15 wherein said conductor nucleus comprises a double twisted bundle wherein the surface of the exterior circumference of said nucleus is substantially in the form of a plain tubular wall.

* * * * *